US009159251B2

(12) United States Patent
Berry

(10) Patent No.: US 9,159,251 B2
(45) Date of Patent: Oct. 13, 2015

(54) MAGNETIC FASTENER FOR COMPETITIVE ATHLETICS

(71) Applicant: Jason Eric Berry, Arlington, VA (US)

(72) Inventor: Jason Eric Berry, Arlington, VA (US)

( * ) Notice: Subject to any disclaimer, the term of this patent is extended or adjusted under 35 U.S.C. 154(b) by 0 days.

(21) Appl. No.: 14/522,879

(22) Filed: Oct. 24, 2014

(65) Prior Publication Data

US 2015/0113843 A1 Apr. 30, 2015

Related U.S. Application Data

(60) Provisional application No. 61/895,891, filed on Oct. 25, 2013.

(51) Int. Cl.

| | |
|---|---|
| ***G09F 7/04*** | (2006.01) |
| ***G09F 3/18*** | (2006.01) |
| ***A41F 1/00*** | (2006.01) |
| *G09F 21/02* | (2006.01) |

(52) U.S. Cl.

CPC . *G09F 7/04* (2013.01); *A41F 1/002* (2013.01); *G09F 2021/023* (2013.01)

(58) Field of Classification Search

USPC ..... 40/315, 661.01, 661.04; 24/303

See application file for complete search history.

(56) References Cited

U.S. PATENT DOCUMENTS

| | | | | |
|---|---|---|---|---|
| 2,214,030 | A * | 9/1940 | Pereles | 40/315 |
| 5,369,899 | A * | 12/1994 | Reeves | 40/1.5 |
| 6,282,760 | B1 | 9/2001 | Mars | |
| 7,246,384 | B2 * | 7/2007 | Bentz | 2/421 |
| 7,721,470 | B2 | 5/2010 | Long | |
| 7,793,518 | B1 * | 9/2010 | Holleman | 63/33 |
| 8,001,661 | B2 | 8/2011 | Clark | |
| 2007/0124898 | A1 * | 6/2007 | Clark | 24/303 |

OTHER PUBLICATIONS

ATHLights, http://athlights.com/faq/ (visited Oct. 4, 2014).
Maggies, http://www.mymaggies.com/ (visited Oct. 4, 2014).

* cited by examiner

*Primary Examiner* — Joanne Silbermann
(74) *Attorney, Agent, or Firm* — Cloudigy Law PLLC

(57) ABSTRACT

Embodiments of the invention affix numbering indicators to clothing of competitors during competitive events. A strong magnetic attraction in conjunction with an interaction between a projection on the bottom surface of a top magnetically attractive member and a hole in the bottom magnetically attractive member resists movement of the numbering indicator, while allowing lateral repositioning. The two magnetically attractive members can be encased in a water-resistant material to prevent degradation or discoloration by exposure to sweat. A graphical layer affixed to the upper surface of the top magnetically attractive member can display a custom visual depiction, such as a brand logo or advertisement. Additionally, a transparent layer can be affixed to the graphical layer to protect it from degradation while also permitting a substantially clear view of the visual depiction.

15 Claims, 3 Drawing Sheets

MAGNETIC FASTENER FOR COMPETITIVE ATHLETICS

CROSS REFERENCE TO RELATED APPLICATIONS

This application claims priority under 35 U.S.C. §119(e) to U.S. Provisional Patent Application Ser. No. 61/895,891, filed Oct. 25, 2013, which is hereby incorporated by reference.

BACKGROUND

1. Field of the Invention

The present invention is related to the field of competitive athletics sportswear. More particularly, the present invention is related to the numbering of individual competitors for identification purposes within the field of competitive athletics sportswear. Even more particularly, the present invention is directed to devices that nondestructively attach wearable identifiers to clothing during competitive events to aid in the identification, tracking, and positioning of individual competitors.

2. Technical Background

The multitude of competitors that participate in competitive athletic events necessitates a system for easily identifying individual competitors. Typically, individuals are identified by their physical characteristics, such as their height, weight, facial features, and vocal patterns. However, this requires that an observer already be familiar with the individuals in order to associate their physical characteristics with their identities. In competitive athletic events where the physical characteristics of many individuals may be masked by their clothing or where some individuals may be unfamiliar to many of the observers, competitors often register for a unique competitor indicator (e.g., a bib number) that then becomes associated with their identity, thus allowing observers and event officials to identify competitors using the indicator instead of the competitors' physical characteristics.

Competitor indicators are often assigned immediately prior to or during competitive events and must be displayed on the competitors' bodies, on a bib comprising a fabric or paper-like material, or on clothing in order to take advantage of the identification system. In many competitive events, constant motion of the competitors' bodies and sweat produced during physical exertion place limits on the methods by which these indicators can be affixed to the competitors' bodies or clothing while ensuring that the indicator remains in place and visible. For example, an indicator attached to a competitor's body or clothing with an adhesive can lose its adhesive quality when subjected to prolonged or continuous periods of movement or when saturated with sweat produced by the competitor's body. Even if applied to the competitor's clothing, sweat can accumulate in the fabric and reduce the adhesive's effectiveness. Additionally, if the indicator needs to be repositioned, some adhesive remains in the original position thereby reducing the amount of adhesive available to secure the indicator in the second and subsequent positions.

Typically, competitor indicators are attached to a competitor's clothing using pins. However, pins are destructive in nature because they require holes to be punctured in the materials being affixed together. Furthermore, pins have a tendency to rust when exposed to rain or sweat and can subsequently stain the materials in contact with the pins. The use of pins to affix indicators to clothing makes repositioning the indicators troublesome because of the necessity to puncture additional holes in the materials being affixed for every pin relocation. Lastly, the pins' sharp points present a risk of injury to hands and body during the installation and removal.

DESCRIPTION OF RELATED ART

Magnets can be an alternative to pins in order to nondestructively affix one object to another. For example, a single magnet can be used to affix an object to a metal surface or to another magnet. A common practice of this type occurs when affixing a paper note to the front surface of a refrigerator door using a magnet. Despite the ubiquity of magnets, however, devices directed to the magnetic affixation of objects to clothing remains limited.

One example of a device that uses magnets to affix an object to clothing is a product called "Athlights." "Athlights" utilizes two magnets to affix a flashing light-emitting diode (LED) to a piece of clothing in order to serve as a warning to approaching motorists. The Athlights product can also be affixed to a variety of materials as a decoration. In operation, one magnet is incorporated into a front element of the product, along with a battery to supply power to the LED, while another magnet is placed underneath clothing. The magnet that is incorporated into the front element of the product has a shell that is nickel-plated and further covered in epoxy in order to resist water. But the front element of an Athlights product lacks a capability to display a visual depiction on its surface, in part because the material on which the visual depiction is printed or contained would block the light from the LED when applied to the surface of the product. Additionally, the small surface area of the magnets' contacting surfaces and the small size of the magnets themselves limits the effectiveness of the Athlights product to resist lateral movement induced by the vibrations and shocks of physical activity.

Another example of this type of device is a product called "Maggies," which consists of a magnetic ball and a ring designed to affix one article of clothing to another or to hold one article of clothing in position by affixing the article to itself. Both the magnetic ball and the ring are made of nickel-coated steel to resist degradation and tarnishing, but neither component has the capacity to display a visual depiction and instead both are intended to remain hidden in the folds of the clothing.

Another device that can affix an object to clothing is the Apparatus for Securing Ornamentation to Personal Items described in U.S. Pat. No. 8,001,661, which depicts a device that affixes an ornamental element to a variety of materials. The device in this patent includes an interchangeable ornamental element as a component of the outer and visible magnetic element and an inner magnetic element that requires either mechanical affixation in a material, much like a rivet is affixed to metal or fabric, or the application of an adhesive to bond the inner magnetic element to a hard surface like ceramic or metal.

A Magnetic Shoe Attachment described in U.S. Pat. No. 7,721,470 and a Magnetic Attachment Device described in U.S. Pat. No. 6,282,760 both describe additional devices for affixing ornamentation to clothing. Each of these two devices can display a visual depiction on the outer surface of the device by using an adhesive to bond an ornamental element to the outer magnetic element, by incorporating the ornamental design into the outer magnetic element, or by providing a mechanical retention mechanism to hold the pin of a separate ornamental element in close proximity to the outer magnetic element. However, both devices rely solely on the force of attraction between the magnets to hold the ornamental element in position. Additionally, although the Magnetic Attachment Device indicates the addition of nickel-plating to the magnetic elements for water resistance, the Magnetic Shoe Attachment does not.

Despite the benefits provided by the prior art devices, they nevertheless fall short of providing a rust-resistant device that simultaneously allows the display of an ornamental element while resisting lateral movement induced by physical activity through a means other than relying solely on the frictional force between the magnets' surfaces and the adjacent material induced by the attraction between the magnets.

SUMMARY

This brief summary is provided to introduce certain concepts in a simplified form that are further described below in the Detailed Description of the Embodiments. This brief summary is not intended to identify key features or essential features of the claimed subject matter, nor is it intended to limit in any way the scope of the claimed invention.

Embodiments of the invention are directed to magnetic fasteners for affixing competitive numbering indicators to clothing. Embodiments of the invention can nondestructively affix numbering indicators to clothing while allowing relatively easy repositioning for optimal viewing. Embodiments of the invention can also resist degradation from exposure to water, whether from environmental sources like rain, snow, mist, and fog, or from sweat produced by the body.

In one embodiment, a first magnetically attractive member comprising a magnetically attractive element, such as a rare earth magnet, retained in a casing and displaying a visual depiction on its outer surface, is placed on the outside of an indicator material (for example, an athlete's bib that is imprinted with a competitor number) to be affixed to clothing. A projection in the casing interacts with an opening or depression in a second magnetically attractive member, comprising a correspondingly polarized magnetically attractive element that is placed underneath the clothing. In such an embodiment, when the two magnetically attractive members are brought sufficiently close together with clothing and indicator material between them, friction created by the attraction between the two magnetic elements in conjunction with the interaction between the projection of the casing of the first magnetically attractive member and the opening or depression in the second magnetically attractive member together resist, but do not prevent, lateral movement of the indicator material with respect to the clothing, thereby affixing the indicator material in substantially one position while allowing some adjustment during use in an athletic competition.

BRIEF DESCRIPTION OF THE DRAWINGS

So that the manner in which the above recited summary features of the present invention can be understood in detail, a more particular description of the invention may be had by reference to embodiments, some of which are illustrated in the appended drawings. It is to be noted, however, that the appended drawings illustrate only typical embodiments of this invention and are therefore not to be considered limiting of its scope, for the invention may admit to other equally effective embodiments.

DETAILED DESCRIPTION

Figure 1:
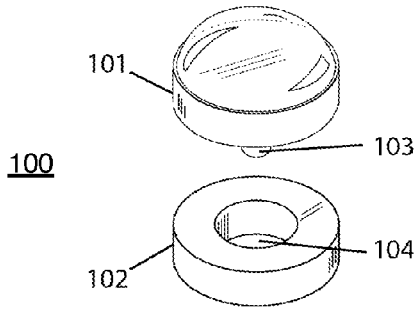
FIG. 1 is a perspective drawing of one embodiment of a magnetic fastener separated into its two magnetically attractive members.

Embodiments of the present invention will be described with reference to the accompanying drawings, wherein like parts are designated by like reference numerals throughout, and wherein the leftmost digit of each reference number refers to the drawing number of the figure in which the referenced part first appears.

FIG. 1 is a perspective drawing of one embodiment of a magnetic fastener separated into its two magnetically attractive members. In FIG. 1, magnetic fastener 100 is separated into a top magnetically attractive member 101 and a bottom magnetically attractive member 102. The magnetically attractive members can be oriented to have magnetic polarizations that cause the two magnetically attractive members 101 and 102 to be magnetically attracted to each other when placed in close proximity. The top magnetically attractive member 101 can have an outward center projection 103 on its underside. The outward center projection 103 can fit into a corresponding depression or opening 104 in the bottom magnetically attractive member 102. The fit between the outward center projection 103 and the opening 104 is preferably loose enough to permit a layer of thin athletic clothing and a layer of suitably thin indicator material to be placed between the top magnetically attractive member 101 and the bottom magnetically attractive member 102 so as to form a reasonably snug fit when the top magnetically attractive member 101 and the bottom magnetically attractive member 102 are brought into close proximity with each other and the outward center projection 103 is pulled at least partially into opening 104 along with an optional layer of clothing and an optional layer of indicator material.

Figure 2:
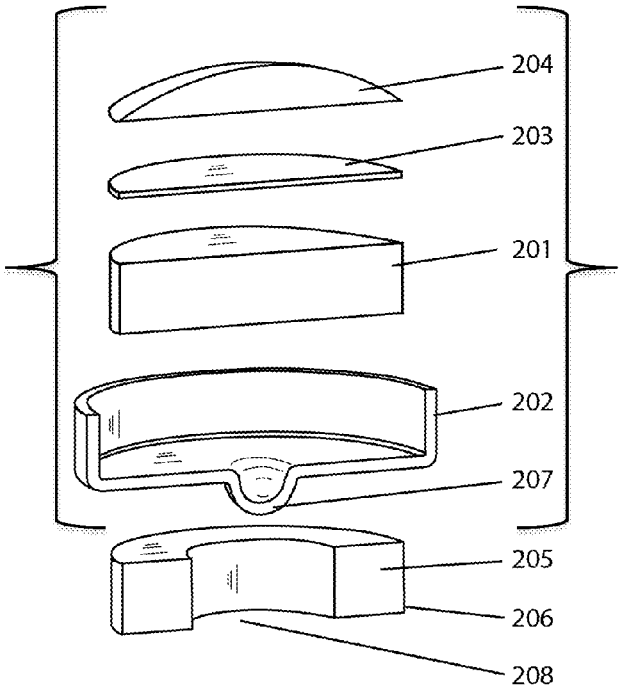
FIG. 2 is an expanded cross-section of an embodiment depicting an arrangement of the components of two magnetically attractive members.

FIG. 2 is an expanded cross-section of an embodiment depicting an arrangement of the components of two magnetically attractive members. As with FIG. 1, magnetic fastener 100 comprises a top magnetically attractive member 101 and a bottom magnetically attractive member 102. The top magnetically attractive member 101 may further comprise a top magnetically attractive element 201, such as rare earth magnet like neodymium, set in a shape-matching casing 202 that is made of a water-resistant or rust-resistant material, such as nickel-plated copper. The top magnetically attractive member 101 and the top magnetically attractive element 201 are both preferably shaped like a flat disc, but other embodiments that employ other shapes are envisioned as well. Such alternative shapes may include, but are not limited to: flat oval, cube, truncated cube, rectangular prism, truncated triangular prism, truncated tetrahedron, truncated octahedron, and the like.

The size of the top magnetically attractive element 201 may be equal to or less than the diameter of the interior space of a correspondingly shaped casing 202, such that the top magnetically attractive element 201 can fit snugly within the casing 202. The casing 202 is preferably approximately 13.5 mm in diameter with a height of approximately 5.8 mm. Thus, the top magnetically attractive element 201 may have a preferable diameter of approximately 12.5 mm with a height of approximately 3.0 mm.

The wall of the casing 202 has a thickness of preferably less than 0.5 mm. The casing 202 has a bottom surface that is generally flat so as to apply pressure and friction to reduce lateral movement of clothing and/or indicator material placed between the top magnetically attractive member 101 and the bottom magnetically attractive member 102 of FIG. 1. However, casing 202 also has an outward center projection 207 on its underside (the side facing the bottom magnetically attractive member 102). In one embodiment, the outward center projection 207 may be generally dome-shaped or bubble-shaped, and may have a base diameter that is preferably between 3 mm and 5 mm. The outward center projection 207 may also have a height that is preferably between 1.5 mm and 2.5 mm. The outward center projection 207 may be configured to have shapes other than a dome or bubble shape. For example, outward center projection 207 may comprise a cylindrical shape, a bullet shape, a conical shape, a prism shape, a tetrahedron shape, or other similar shape.

A graphical element 203 can be optionally affixed to the upper surface of the top magnetically attractive element 201 and an optionally transparent cover layer 204 can be affixed over the graphical element 203, or alternatively over the top magnetically attractive element 201, in a manner that allows a visual depiction printed on the graphical element 203 to be viewed through the transparent cover layer 204. The graphical element 203 can be customized with any sort of ornamental design known in the art, and may include the use of different types of material, including reflective materials.

The height of the casing 202 is preferably sufficient to accommodate the top magnetically attractive element 201, the optional graphical element 203, and the optionally transparent cover layer 204. The cover layer 204 may comprise an acrylic material or other similar transparent material known in the art. The cover layer 204 may have a dome or bubble shape, or may also have a flat disc shape or other similar shape suitable to provide a protective layer over the graphical element 203 or alternatively over the top magnetically attractive element 201. The transparent cover layer 204 may have a preferable diameter approximately equal to the diameter of the top magnetically attractive element 201 and a height of approximately 1.5 mm.

The bottom magnetically attractive member 102 (of FIG. 1) comprises a bottom magnetically attractive element 205 enclosed within water-resistant material 206 such as nickel plating. The bottom magnetically attractive element 205 is configured to have an opening or depression 208 in its center, which corresponds in location, size and shape to the outward center projection 207 of the top magnetically attractive element 201. Thus, the bottom magnetically attractive member 102 will preferably retain the same general shape as the bottom magnetically attractive element 205.

The bottom magnetically attractive member 102 and the bottom magnetically attractive element 205 are both preferably shaped like a cylindrical ring, where the opening 208 can be an actual hole that extends through the entire bottom magnetically attractive element 205 and similarly extends through the entire bottom magnetically attractive member 102. The cylindrical ring shape enables the bottom magnetically attractive member 102 to be used equally well when positioned right side up or upside down. This feature enables the bottom magnetically attractive member 102 to be positioned easily without regard to the magnetic polarity of the bottom magnetically attractive element 205 relative to the top magnetically attractive element 201. If the polarity of the bottom magnetically attractive element 205 happens to be opposite of the polarity of the top magnetically attractive element 201, the user-athlete-competitor individual can simply flip the bottom magnetically attractive member 102 upside down. The symmetrical nature of the cylindrical ring shape of the bottom magnetically attractive member 102 and the bottom magnetically attractive element 205 enable the opening 208 to accommodate the athlete's clothing (item 909 of FIG. 9), the competitor indicator (item 910 of FIG. 9) and the center projection 207, regardless of orientation.

Other embodiments may employ other shapes for the bottom magnetically attractive member 102 and the bottom magnetically attractive element 205. Such alternative shapes may include, but are not limited to, shapes that can accommodate all of the shapes that are possible for the outward center projection 207.

In one embodiment, the opening or depression 208 in the center of the bottom magnetically attractive member 102 has a diameter that is preferably greater than the diameter of the outward center projection 207 of the casing 202. The outer diameter of the bottom magnetically attractive element 205 is preferably similar to the outer diameter of the top magnetically attractive element 201. However, the outer diameter of the bottom magnetically attractive element 205 may be made larger or smaller than the outer diameter of the top magnetically attractive element 201, to facilitate separation of the two magnetically attractive elements 201 and 205. The height of the bottom magnetically attractive element 205 is preferably 3.175 mm.

Figure 9:
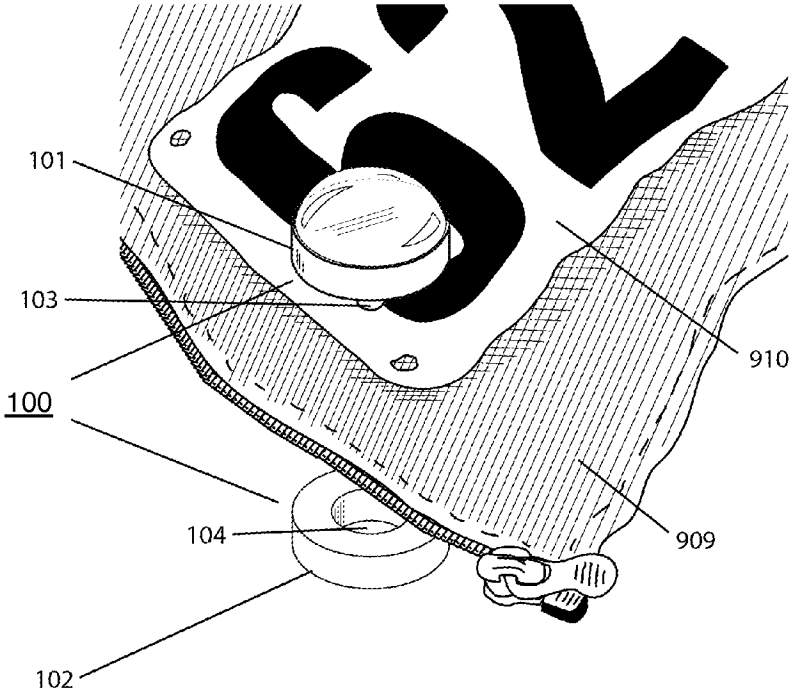
FIG. 9 is an angular perspective of one embodiment of a magnetic fastener showing its two magnetically attractive members 101 and 102 in a magnetically separated configuration with a competitor's clothing 909 and the competitor's indicator 910 shown between the magnetically attractive members.

Now referring to both FIG. 2 and FIG. 9, the diameter of the opening or depression 208 in the center of the bottom magnetically attractive element 205 is preferably 6.35 mm. The polarization of the bottom magnetically attractive element 205 is oriented so that the when the two magnetically attractive elements 201 and 205 are placed in close proximity and the outward center projection 207 of the casing 202 begins to approach the opening or depression 208 within the bottom magnetically attractive element 205, the magnetic force between the two magnetically attractive elements 201 and 205 will attract them together to firmly hold the indicator material 910 onto the athlete's clothing material 909 in such a way as to resist, but not prevent, lateral movement of the indicator material 910 with respect to the athlete's clothing material 909, thereby affixing the indicator material 910 in a substantially fixed position while allowing some adjustment to be performed when desired.

Figure 3:
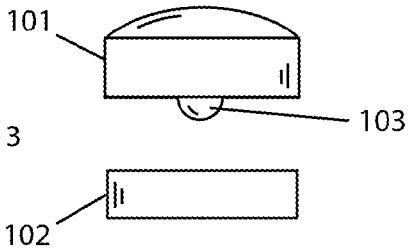
FIG. 3 is a side perspective of one embodiment of a magnetic fastener showing its two magnetically attractive members 101 and 102 in a magnetically separated configuration.

FIG. 3 is a side perspective of one embodiment of a magnetic fastener showing its two magnetically attractive members 101 and 102 in a magnetically separated configuration.

Figure 4:
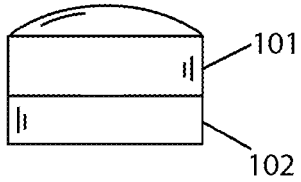
FIG. 4 is a side perspective of one embodiment of a magnetic fastener showing its two magnetically attractive members 101 and 102 in a magnetically attached configuration.

FIG. 4 is a side perspective of one embodiment of a magnetic fastener showing its two magnetically attractive members 101 and 102 in a magnetically attached configuration.

Figure 5:
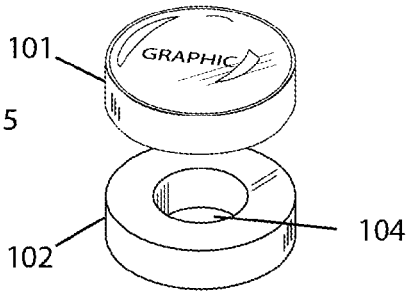
FIG. 5 is an angular perspective looking down on one embodiment of a magnetic fastener and showing its two magnetically attractive members 101 and 102 in a magnetically separated configuration and also showing how a graphical element 203 can be viewed through the transparent cover layer 204.

FIG. 5 is an angular perspective looking down on one embodiment of a magnetic fastener and showing its two magnetically attractive members 101 and 102 in a magnetically separated configuration and also showing how a graphical layer element (identified in FIG. 2) can be viewed through the transparent cover layer 204 of FIG. 2.

Figure 6:
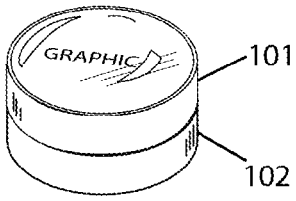
FIG. 6 is an angular perspective looking down on one embodiment of a magnetic fastener and showing its two magnetically attractive members 101 and 102 in a magnetically attached configuration and also showing how a graphical element 203 can be viewed through the transparent cover layer 204.

FIG. 6 is an angular perspective looking down on one embodiment of a magnetic fastener and showing its two magnetically attractive members 101 and 102 in a magnetically attached configuration and also showing how a graphical element 203 (identified in FIG. 2) can be viewed through the transparent cover layer 204 of FIG. 2.

Figure 7:
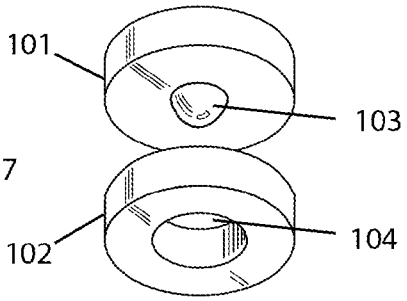
FIG. 7 is an angular perspective looking up on one embodiment of a magnetic fastener showing its two magnetically attractive members 101 and 102 in a magnetically separated configuration and also showing how the outward projection 103 can be positioned to fit within opening 104.

FIG. 7 is an angular perspective looking up on one embodiment of a magnetic fastener showing its two magnetically attractive members 101 and 102 in a magnetically separated configuration and also showing how the outward projection 103 (also element 207 shown in FIG. 2) can be positioned to fit within opening 104 (also element 208 of FIG. 2).

Figure 8:
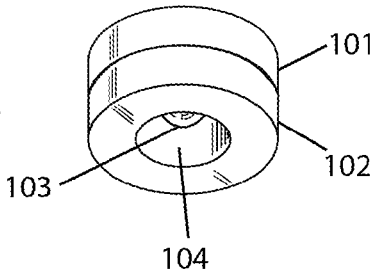
FIG. 8 is an angular perspective looking up on one embodiment of a magnetic fastener showing its two magnetically attractive members 101 and 102 in a magnetically attached configuration and also showing how the outward projection 103 can fit within opening 104.

FIG. 8 is an angular perspective looking up on one embodiment of a magnetic fastener showing its two magnetically attractive members 101 and 102 in a magnetically attached configuration and also showing how the outward projection 103 (also element 207 shown in FIG. 2) can fit within opening 104 (also element 208 of FIG. 2).

FIG. 9 is an angular perspective of one embodiment of a magnetic fastener showing its two magnetically attractive members 101 and 102 in a magnetically separated configuration with a competitor's clothing 909 and the competitor's indicator 910 shown between the magnetically attractive members. When the two magnetically attractive members are brought into close proximity, the top magnetically attractive member 101, together with outward projection 103, will press against competitor's indicator 910. Similarly, the bottom magnetically attractive member 102 will press against the competitor's clothing 909. As the two magnetically attractive members 101 and 102 are drawn closer to each other, the outward projection 103 will force itself, together with a portion of the competitor's clothing 909 and a portion of the competitor's indicator 910 into the opening 104 in the bottom magnetically attractive member 102, thereby securing the competitor's indicator 910 in substantially one position next to the competitor's clothing 909, while allowing some adjustment.

Figure 10:
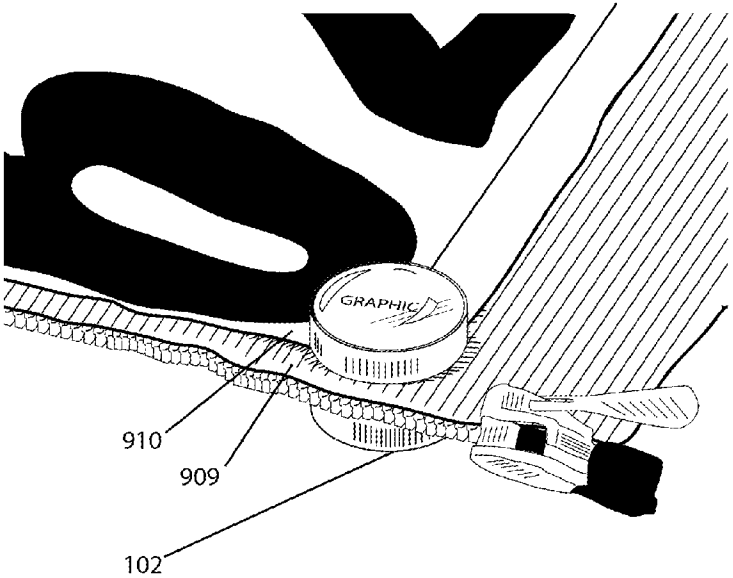
FIG. 10 is an angular perspective of one embodiment of a magnetic fastener showing its two magnetically attractive members 101 and 102 in a magnetically attached configuration with a competitor's clothing 909 and the competitor's indicator 910 shown sandwiched between the attached magnetically attractive members.

FIG. 10 is an angular perspective of one embodiment of a magnetic fastener showing its two magnetically attractive members 101 and 102 in a magnetically attached configuration with a competitor's clothing 909 and the competitor's indicator 910 shown sandwiched between the attached magnetically attractive members, thereby holding the competitor's indicator 910 in substantially one position next to the competitor's clothing 909, while allowing some adjustment.

Returning to FIG. 2, the magnetically attractive elements 201 and 205 of the embodiments each preferably have a magnetic strength of N35, which corresponds to 35 Mega Gauss units or 3500 Tesla units of magnetic flux density. The strength of the magnetic attraction of the magnetically attractive elements 201 and 205 can play a crucial role in certain athletic events. Consider, for example, cycling, where competitors often reach speeds in excess of 40 miles per hour. A weak magnet system could cause the competitor's indicator 910 to come loose under forces created by wind flow and turbulence. Nevertheless, embodiments having other magnetic strengths are also envisioned, depending on a variety of factors known in the art, including the type of athletic competition and the anticipated forces that may be exerted on the competitors, the competitors' clothing, and the competitors' indicators.

The magnetically attractive elements 201 and 205 of the embodiments can be plated with a water-resistant material, such as nickel, nickel-plated copper, or other plating material known in the art. The casing 202 can also be composed of a water-resistant material, such as nickel, nickel-plated copper, or other plating material known in the art, to resist rust, corrosion and degradation.

In some embodiments, the magnetically attractive elements 201 and 205 can be encased in plastic in addition to or opposed to being plated with a water-resistant or rust-resistant material, to reduce the risk of irritation or allergic reaction from exposure of the skin to nickel and related materials.

The magnetically attractive elements 201 and 205 may be made of magnetically attractive materials such as neodymium, alloys of neodymium, strontium, samarium or other magnetically attractive materials known in the art.

The foregoing disclosure has been set forth merely to illustrate the invention and is not intended to be limiting. It will be appreciated that modifications, variations and additional embodiments are covered by the above teachings and within the purview of the appended claims without departing from the spirit and intended scope of the invention. Because modifications of the disclosed embodiments incorporating the spirit and substance of the invention may occur to persons skilled in the art, the invention should be construed to include everything within the scope of the appended claims and equivalents thereof.

The invention claimed is:

1. A magnetic fastener comprising:

a first magnetically attractive element recessed within a casing, said casing having a dome-shaped center projection extending away from the first magnetically attractive element and toward a second magnetically attractive element;

said second magnetically attractive element having a center opening, said center opening being large enough to accommodate the center projection of the casing;

said dome-shaped center projection having a height sufficient to exert a force against two or more layers of material that are disposed together between said first and second magnetically attractive elements when the dome-shaped center projection of the first magnetically attractive element is brought into close proximity and alignment with the center opening of the second magnetically attractive element;

said force being strong enough to hold said two or more layers of material against each other;

said force being weak enough to permit a positional adjustment of one of the layers of material relative to another of the layers of material.

2. The magnetic fastener of claim 1, wherein either or both of said first and second magnetically attractive elements is/are plated with a material that includes nickel plated.

3. The magnetic fastener of claim 1, wherein either or both of said first and second magnetically attractive elements comprise(s) (a) rare-earth magnet(s).

4. The magnetic fastener of claim 1, wherein a graphical element is affixed to the upper surface of the first magnetically attractive element opposite from the center projection of the casing, wherein the outer surface of the graphical element includes a visual depiction, and further wherein a transparent layer is affixed to the outer surface of the graphical element.

5. The magnetic fastener of claim 4, wherein said transparent layer is acrylic.

6. The magnetic fastener of claim 5, wherein said transparent layer is disc-shaped.

7. The magnetic fastener of claim 5, wherein said transparent layer is dome-shaped.

8. The magnetic fastener of claim 1, wherein one of the at least two layers of material comprises an indicator material that at least partly comprises a natural fabric or synthetic fabric.

9. The magnetic fastener of claim 1, wherein one of the at least two layers of material comprises an indicator material that at least partly comprises TYVEK™ (superbonded olefin), paper, or plastic.

10. The magnetic fastener of claim 1, wherein said first and/or second magnetically attractive element(s) has (have) a disc shape.

11. The magnetic fastener of claim 1, wherein said first and/or second magnetically attractive element(s) has(have) a triangular, rectangular, square, or oval shape.

12. The magnetic fastener of claim 1, wherein said first and second magnetically attractive elements have a magnetic strength substantially close to 35 Mega Gauss.

13. The magnetic fastener of claim 1, wherein said second magnetically attractive element and/or said casing are(is) encased in a material that includes plastic.

14. The magnetic fastener of claim 1, wherein said casing has an outer diameter of approximately 13.5 mm and a height of approximately 5.8 mm.

15. A method of using a magnetic fastener comprising:

positioning a first layer of material adjacent to a second layer of material;

placing a first magnetically attractive element on a surface of the first layer of material opposite from the second layer of material; and placing a second magnetically attractive element on a surface of the second layer of material opposite from the first layer of material such that the first and second magnetically attractive elements remain substantially fastened with the two layers of material disposed between them;

wherein the first magnetically attractive element is recessed within a casing, said casing having a dome-shaped center projection extending toward a center opening in the second magnetically attractive element when the center of the first and second magnetically attractive elements are aligned, said center opening being large enough to accommodate the center projection, and wherein a force exerted on the first and second layers of material by the magnetic attraction of the first and second magnetically attractive elements and a deflection of the first and second layers of material around the center projection is strong enough to hold the first layer of material against the second layer of material, and wherein the force is weak enough to permit a manual positional adjustment of the first layer of material relative to the second layer of material.

* * * * *